US005129441A

United States Patent [19]

Leist et al.

[11] Patent Number: 5,129,441

[45] Date of Patent: Jul. 14, 1992

[54] SECTIONAL DOORS AND COMPRESSIBLE FLEXIBLE HINGE ASSEMBLIES

[75] Inventors: Alan R. Leist, Cincinnati, Ohio; Thomas E. Youtsey, Bellvue, Ky.

[73] Assignee: Clopay Corporation, Cincinnati, Ohio

[21] Appl. No.: 660,683

[22] Filed: Feb. 25, 1991

Related U.S. Application Data

[63] Continuation-in-part of Ser. No. 345,562, May 1, 1989, Pat. No. 4,995,441.

[51] Int. Cl.[5] ..... E06B 3/70

[52] U.S. Cl. ..... 160/229.1; 160/231.2

[58] Field of Search ..... 160/229.1, 231.1, 231.2, 160/201, 264, 266; 16/DIG. 13; 52/585

[56] References Cited

U.S. PATENT DOCUMENTS

| | | | |
|---|---|---|---|
| 2,311,470 | 2/1943 | Ritter . | |
| 2,411,902 | 12/1946 | Skelly . | |
| 2,458,537 | 1/1949 | Skelly | 160/229.1 X |
| 2,607,411 | 8/1952 | Van Vliet | 169/231.2 |
| 2,812,023 | 11/1957 | Laity | 160/229.1 X |
| 2,831,537 | 4/1958 | Ritter . | |
| 2,978,020 | 4/1961 | Paulsrude . | |
| 3,132,432 | 5/1964 | Yee | 160/231.1 X |
| 3,148,724 | 9/1964 | Chieger et al. . | |
| 3,198,242 | 8/1965 | Crosswell . | |
| 3,302,690 | 2/1967 | Hurd . | |
| 3,347,305 | 10/1967 | Urbanick . | |
| 3,411,561 | 11/1968 | Mock | 160/231.2 |
| 3,424,222 | 1/1969 | Stoner et al. . | |
| 3,527,283 | 9/1970 | Butler | 160/229.1 |
| 3,894,571 | 7/1975 | Hinchliff . | |
| 4,131,971 | 1/1979 | Saarloos . | |
| 4,563,381 | 1/1986 | Woodland . | |
| 4,793,397 | 12/1988 | Whiteman | 160/201 |
| 4,828,004 | 5/1989 | Martinez | 160/201 |

FOREIGN PATENT DOCUMENTS

| | | |
|---|---|---|
| 2901371 | 7/1980 | Fed. Rep. of Germany . |
| 3244743 | 6/1984 | Fed. Rep. of Germany . |
| 8703826 | 3/1987 | Fed. Rep. of Germany . |
| 482898 | 1/1970 | Switzerland . |

*Primary Examiner*—J. Franklin Foss

*Attorney, Agent, or Firm*—Wood, Herron & Evans

[57] ABSTRACT

Novel compressible flexible hinge assemblies for connecting abutting panel sections of upward acting or sectional doors, such as garage doors, are disclosed. More particularly, abutting panel sections of an upward acting door are hingedly connected together economically and in a weather-tight relationship by a flexible hinge assembly which can be easily installed without the use of tools by snapping it into predesigned elongated slots in the abutting panel sections from the rear or interior side of the door. When assembled, a compressible flexible hinge assembly of the present invention provides a smooth, flush back surface on the rear or interior side of an upward acting door and eliminates the unsightly appearance associated with conventional metal hardware heretofore used to hinge abutting panel sections of upward acting doors. A novel compressible flexible hinge assembly in accordance with the present invention comprises an elongated flexible hinge having first and second arms connected to a central web formed with a material substantially resistant to flexure fatigue and two elongated compressible slats wherein each arm of the hinge is adapted to be inserted into one elongated slot along the abutting edge of one abutting panel section and each compressible slat is adapted to compress when being inserted into or removed from one of the elongated abutting slots to lock the flexible hinge in the elongated slots and hingedly connect together the abutting panel sections for articulation with respect to each other.

29 Claims, 4 Drawing Sheets

SECTIONAL DOORS AND COMPRESSIBLE FLEXIBLE HINGE ASSEMBLIES

RELATED APPLICATIONS

This is a continuation-in-part application of U.S. patent application, Ser. No. 07/345,562, which was filed on May 21, 1989 and will issue into U.S. Pat. No. 4,995,441 on Feb. 26, 1991.

FIELD OF THE INVENTION

The present invention relates to a sectional door and a compressible flexible hinge assembly comprising an elongated flexible hinge and elongated compressible retainer slats wherein the abutting panel sections of the door are hingedly secured for articulation with respect to each other by the compressible flexible hinge assembly.

BACKGROUND

Generally, door panel sections for upward acting doors are connected together by spaced hinges which typically are comprised of pairs of metal plates having interengaging hinge pins. The metal plates are usually arranged so that each metal plate of a pair is fastened to abutting panel sections. While some of the adjoining panel sections are arranged to have interlocking abutting edges, these have not always proven to be weather tight. Furthermore, metal hinges are subject to corrosion and rusting. To prevent such rusting and provide for easier operation, it is advisable to oil the hinge pins from time to time. Not only is this messy but requires an adequate maintenance schedule to keep rust from forming. Moreover, the use of metal hinges results in an inferior appearance on the inside or rear face of such upward acting doors due to the objectionable appearance of the metal hinges located thereon.

Consequently, there is a need for hinge arrangements that can eliminate the objectionable maintenance and unsightly appearances associated with metal hinges, yet which can operate as effectively as metal hinges to hingedly secure together abutting panel sections of upward acting doors.

SUMMARY OF THE INVENTION

In brief, the present invention seeks to alleviate the above-mentioned problems and disadvantages associated with metal hinges through the discovery of a novel flexible hinge assembly for hingedly securing together abutting panel sections of upward acting doors which are generally used to close garages, service entrances for commercial buildings, loading dock areas, truck bodies and the like.

Each flexible hinge assembly of the present invention is designed to cooperate with mating elongated, longitudinal slots provided in two abutting panel sections of upwardly acting doors to hingedly secure the panel sections together for articulation with respect to each other. The configuration of the novel flexible hinge assemblies of the instant invention are such that they can be easily snapped into place in the elongated mating slots of the abutting panel sections from the rear faces of the panel sections rather than having to slide the flexible hinge assemblies in from the ends of the panel sections. Moreover, installation of the novel flexible hinge assemblies can be accomplished without having to resort to tools thereby significantly shortening the time required to assemble the upward acting doors of the present invention.

More particularly, the novel flexible hinge assemblies of the present invention comprise an elongated flexible hinge component and two elongated retainer slat components. The flexible hinge component typically comprises first and second arms or flanges connected to a central web formed of a material which is substantially resistant to flexure fatigue wherein each arm is inserted into one respective mating elongated slot in one abutting panel section of an upward acting door. Each retainer slat component is then snapped into one respective mating elongated slot in contact with one arm to lock the plastic hinge component in place so that the abutting panel sections are hingedly secured together by the flexible hinge and retainer slat components for articulation with respect to each other.

In an alternative construction, the flexible hinge assembly includes a flexible hinge and elongated compressible retainer slats wherein each slat comprises a compressible member connected preferably to a rigid arm. The compressible member is uniquely designed to collapse or compress during installation or removal so that each slat can be conveniently snapped into or out of place. In addition, the compressible member is designed so as to form a pivot point with a portion of a corresponding panel section to aid in installation or removal of the compressible slats. Because this alternative compressible flexible hinge assembly is easy to assemble and disassemble, the sectional doors formed with this alternative hinge assembly can be conveniently disassembled and relocated or selectively disassembled so selected parts can be replaced. Moreover, this unique construction permits the compressible flexible hinge assembly to adjust to tolerance variations caused by, for example, manufacturing imperfections, increases in load following installation and changes in environmental conditions, so that convenient and effective operation of sectional doors assembled with these hinge assemblies can be maintained.

In a further feature, the unique hinge assemblies of the present invention provide a continuous weather strip seal between abutting panel sections which act to seal off any air and adverse weather infiltration. In addition, the novel design of the flexible hinge assemblies eliminates the need for a vertical space between abutting panel sections for pivot purposes as required with conventional garage door hardware. In still another feature, the novel flexible hinge assemblies experience substantial longevity due to the fact that the total rotation between abutting panel sections of an upward acting door is typically no more than about 80°-90°.

In yet a further feature, the unique designs of the flexible hinge assemblies of the present invention eliminate undesirable pinch points on the rear side or faces between abutting panel sections, especially when the abutting panel sections are in different planes during the opening and closing process of the upward acting doors. Moreover, such unique designs provide a superior appearance on the inside or rear faces of assembled upward acting doors by eliminating the unsightly hinge hardware, straps and/or bolts commonly associated with metal hinges. In addition, the unique designs of the novel flexible hinge assemblies of the present invention reduce the level of noise normally associated with the operation of upwardly acting doors and provide stronger hinges for such doors since the load of each panel is distributed uniformly along the entire length of the novel hinge assemblies, which typically is equal to the length of the panels. In yet another feature of the novel flexible hinge assemblies of the present invention, they can be designed to be thermally self-adjusting so that the changes in the curvature of the upward acting doors, caused by heat or cold, can be adjusted to permit the plastic hinge assemblies to continue to effectively operate.

The above and other features and advantages of the present invention, including various novel details of design will now be more particularly described with reference to the figures and detailed description and pointed out in the claims. It should be understood that flexible hinge assemblies embodying the present invention are shown by way of illustration only and are not meant to limit the invention. It should be further understood that the principles and features of the present invention may be employed in various and numerous embodiments without departing from the scope of the present invention.

DESCRIPTION OF THE FIGURES

Reference is now made to the accompanying figures in which are shown illustrative embodiments of the present invention from which its novel features and advantages will be apparent.

DETAILED DESCRIPTION OF THE INVENTION

By way of illustrating and providing a better appreciation of the present invention and attendant advantages thereof, the following detailed description is given concerning the upward acting doors and flexible hinge assemblies.

Figure 4:
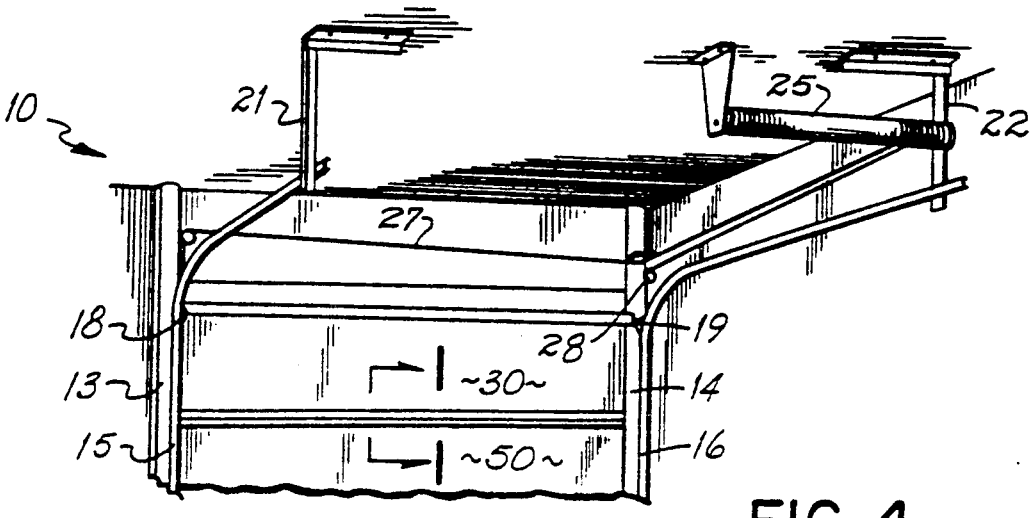
FIG. 4 is a perspective view of an overall installation of an upward acting door of the present invention.

Referring now to FIG. 4 of the figures, an upward acting door 10 is mounted to close an opening formed between door jams 13 and 14. Door 10 is arranged to ride in tracts 15 and 16 by means of rollers 18 and 19. Tracts 15 and 16 are secured for a portion of their lengths to jams 13 and 14 and then, after forming a turn, are supported near their free ends by supporting brackets 21 and 22, respectively.

A torsion spring and/or extension spring 25 is positioned to cooperatively engage cables 27 and 28 attached to the bottom edge (not shown) of door 10 to assist in raising the door in the usual manner. Of course, it should be understood that the present invention can be utilized with sectional doors which operate with counter balancing systems different from those illustrated in FIG. 4. Door 10 is made up of a series of panel sections, of which only two, 30 and 50 alternatively 130 and 150, are shown.

The description, thus far, concerns a conventional upward acting door, door mechanism and components as generally known to those versed in the art. These mechanisms and components are exemplary and operate in the well known manner to raise and lower the door 10.

Reference may now be had to FIGS. 1, 2, 5, 6 and 7 for a more detailed consideration of a novel flexible hinge assembly 70 of the instant invention and its manner of connection with abutting or adjoining panel sections of an upward acting door.

Figure 1:
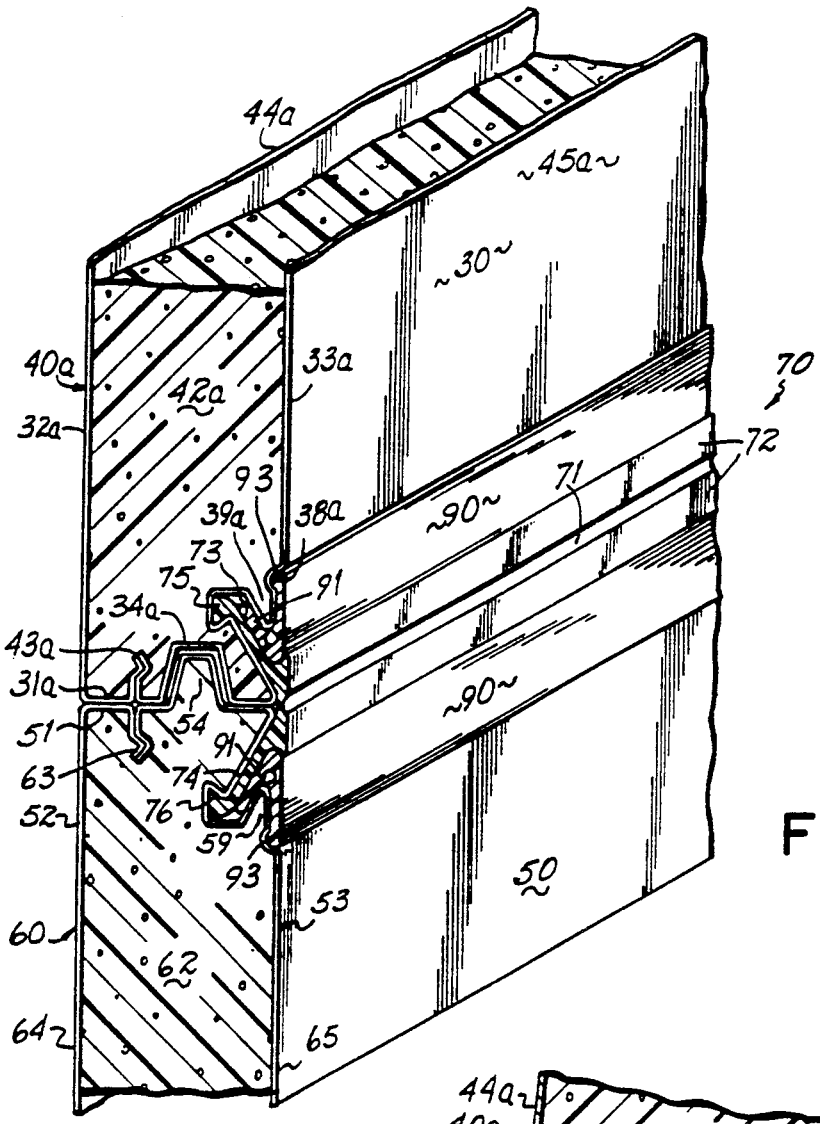
FIG. 1 is a cross-sectional view of a portion of an upward acting door taken along lines 1—1 of FIG. 4.
Figure 2:
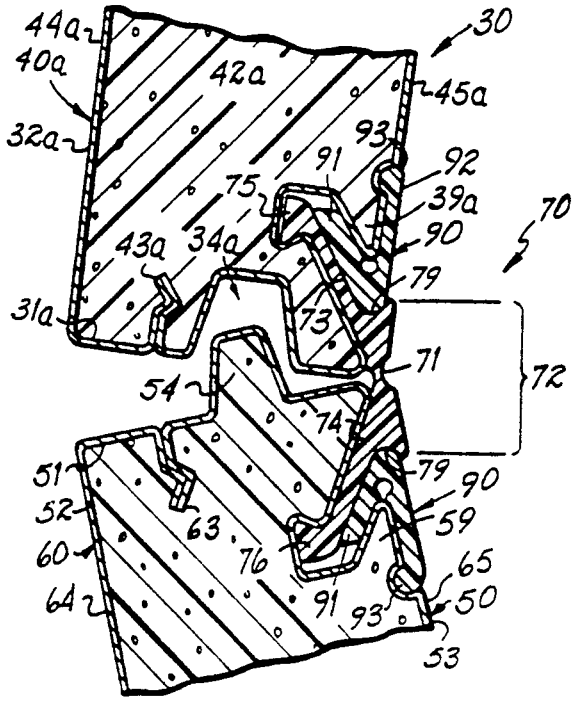
FIG. 2 is a cross-sectional view similar to that of FIG. 1 but with door sections of an upward acting door displaced relative to each other as the door is raised or lowered along its tract.
Figure 5:
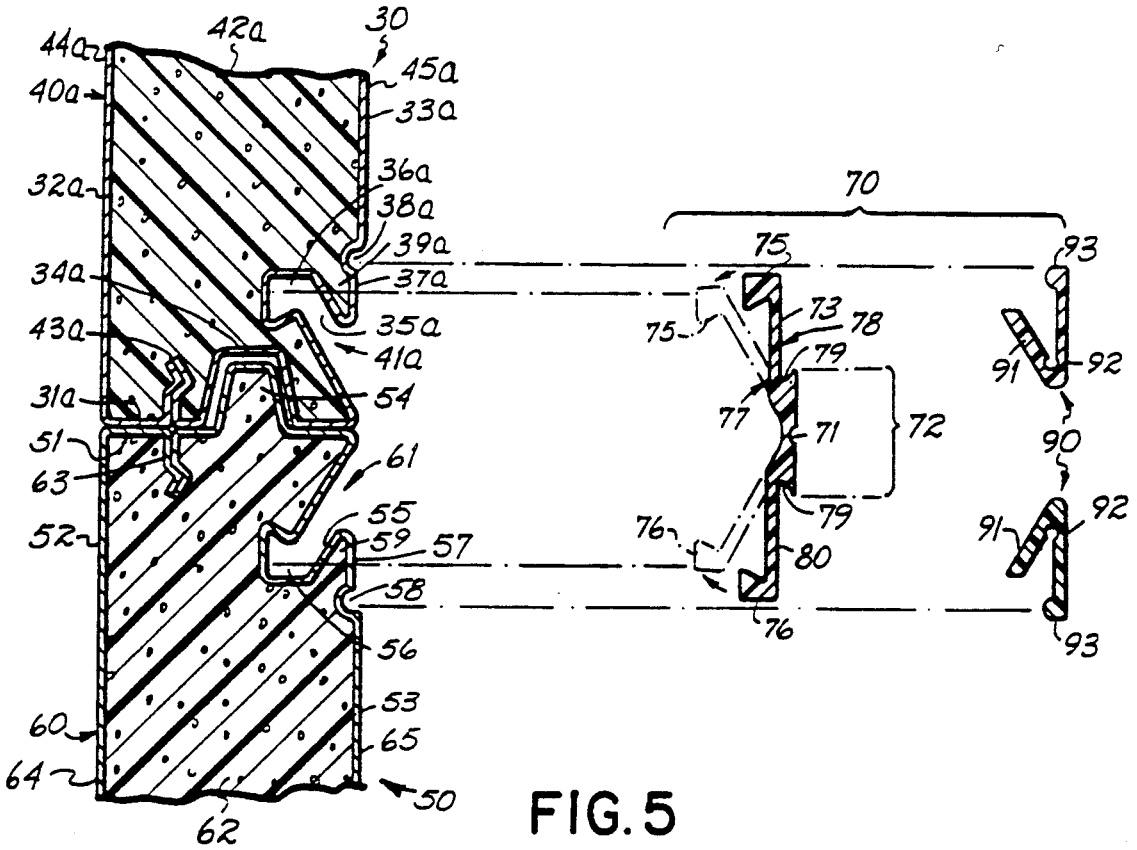
FIG. 5 is a cross-sectional exploded view of a portion of an unassembled upward acting door and plastic hinge assembly along lines 1—1 of FIG. 4.

In FIGS. 1, 2 and 5, they show abutting edges of elongated panel sections 30 and 50 with flexible hinge 70, in engagement therewith, of a portion of a door in a closed or lowered position, an articulated position, or a closed or lowered and unassemblied position, respectively. The lower elongated panel section 50 comprises a generally U-shaped structure 60 of, for example, extruded aluminum, steel, or other metal, plastic or the like with a base 51 and two upstanding, parallel front and back flanges 52 and 53, respectively, in spaced relationship. As part of base 51, a notch 54 is formed.

Front flange 52 preferably is connected integrally and longitudinally along the front edge of base 51. Back flange 53 is preferably connected integrally and longitudinally along the upper edge of an elongated, longitudinal slot 55 and at the back or inside edge of base 51, as shown in FIG. 5. Elongated slot 55 is further provided and in communication with an elongated, longitudinal recess 56. Both slot 55 and recess 56 are formed by back flange 53.

In addition, back flange 53 forms an elongated, longitudinal groove 57 in communication with elongated slot 55. At the non-communicating end of elongated, longitudinal groove 57 is an elongated, longitudinal recess 58. Slot 55 is partially closed by an elongated short flange 59 extending longitudinally along back flange 53 and upwardly but short of the underside base 51, leaving a gap for the insertion of flexible hinge 70 into elongated slot 55 and recess 56. Together, slot 55, recess 56, groove 57, recess 58 and short flange 59, all of which are formed by back flange 53, form an overall elongated, longitudinal slot 61 of generally V-shaped cross-section which extends longitudinally along back flange 53 near the back or inside edge of base 51.

Filled within the U-shaped structure 60 of lower panel section 50 between base 51 and front and back flanges 52 and 53, respectively, is a light weight, preferably insulative foam 62 comprised of, for instance a polyurethane or the like. As an alternative, an expanded polystyrene bead board or rigid foam may be used. Of course, it should be understood that panel sections which are not filled with a foam can also be employed with this invention. An elongated, longitudinal downwardly and inwardly projecting rib 63 from base 51 aids in holding the U-shaped structure 60 to foam 62.

Since the upper panel section 30 is substantially complimentary to that of lower panel section 50, the corresponding members have been designated with corresponding numbers in the 30s and 40s, respectively, and having the suffix (a) appended thereafter. The main difference between upper and lower panel sections 30 and 50, respectively, lies in the formation of the base wherein the upper base 51 of lower panel section 50 is shaped with an elongated, longitudinal notch 54 whereas the lower base 31*a* of upper panel section 30 is shaped with an elongated, longitudinal slot 34*a* which mates with longitudinal notch 54 when upper and lower panel sections 30 and 50, respectively, are in an abutting or adjoining relationship.

Turning now to a more detailed discussion of FIG. 2, it shows that panel sections 30 and 50 of FIG. 1 are hingedly secured to each other in an operative condition when the door is being opened or closed and panel sections 30 and 50 are in different planes as they ride over the bend in tracts 15 and 16. It can easily be seen that elongated flexible hinge 70 flexes longitudinally along a central recessed axis. The recessed area 71 is provided by a thin section in central web 72 of hinge 70. Elongated central web 72 is located between major arm flanges 73 and 74. Elongated arm flanges 73 and 74 extend at a generally acute to linear angle away from main centrally, longitudinally recessed web 72. Longitudinal anchoring flanges 75 and 76 are connected to the free ends of longitudinal arm flanges 73 and 74, respectively, and extend at a generally perpendicular angle away from central web 72. Flexible hinge 70 is provided with interior and exterior sides 77 and 78. Central web 72 is provided with a pair of elongated, longitudinal grooves 79 and 80 extending along the exterior surface 78 of central web 72 and spaced from each other. It should be understood, however, that when flexible hinge 70 is in an unassembled extruded form, it may be linear shape or V-shape cross section as illustrated in FIG. 5. The V-shape cross section as shown in FIG. 5 is in phantom.

Once inserted into overall elongated slots 61 and 41*a* of abutting panels, flexible hinge 70 is generally of V-shape cross-section with the anchoring flanges 75 and 76 being integrally connected to the free edges of longitudinal arm flanges 73 and 74 on the interior side of flexible hinge 70; the interior anchoring flanges 75 and 76 being positioned generally perpendicular to the spaced longitudinal arm flanges 73 and 74. The interior sides of arm flanges 73 and 74 and anchoring flanges 75 and 76 are shaped so as to engage the interior surfaces of back flanges 53 and 33*a* and longitudinal recesses 56 and 36*a* of lower and upper panels 50 and 30, respectively, as depicted in FIG. 5. The anchoring flanges 75 and 76 form short stubs for anchoring flexible hinge 70 within the overall elongated, longitudinal slots 61 and 41*a* of lower and upper panel sections 50 and 30, respectively.

Once flexible hinge 70 has been inserted into the V-shape cross-section overall elongated slots 41*a* and 61 in upper and lower panel sections 30 and 50, respectively, by the insertion of longitudinal arm flanges 73 and 74 into mating slots 35*a* and 55 and longitudinal recesses 36*a* and 56, respectively, longitudinal retainer slats 90 are snapped into upper and lower panel sections 30 and 50, respectively, in contact with arm flanges 73 and 74 to lock flexible hinge 70 in place. Elongated, longitudinal retainer slats 90 are generally comprised of V-shape cross-section structures designed to mate with short flanges 39*a* or 59, the exterior sides 78 of longitudinal arm flanges 73 and 74 of flexible hinge 70 and the longitudinal grooves 37*a* or 57 of lower and upper panel sections 30 or 50, respectively.

More particularly, elongated, longitudinal retainer slats 90 comprise a first longitudinal arm 91 for inserting into mating slots 55 or 35(*a*) to be wedged between the exterior sides 78 of longitudinal arm flanges 73 or 74 of flexible hinge 70 and short flanges 59 or 39*a* of back flanges 53 or 33*a*, respectively, and a second longitudinal arm 92 for inserting into mating longitudinal grooves 37*a* or 57. At the end of second arm 92 is a longitudinal notch 93 for mating with longitudinal recesses 38*a* or 58 of upper and lower panel sections 30 or 50, respectively. Preferably, longitudinal grooves 37*a* and 57 and longitudinal recesses 38*a* and 58 of upper or lower panel sections 30 or 50, respectively, are of a design so that they correspond with second longitudinal arms 92 and notches 93 to such an extent that the back sides 45*a* or 65 of panel sections 30 or 50, respectively, when in an abutting relationship, are substantially smooth and flush with flexible hinge 70 and retainer slats 90.

Figure 3:
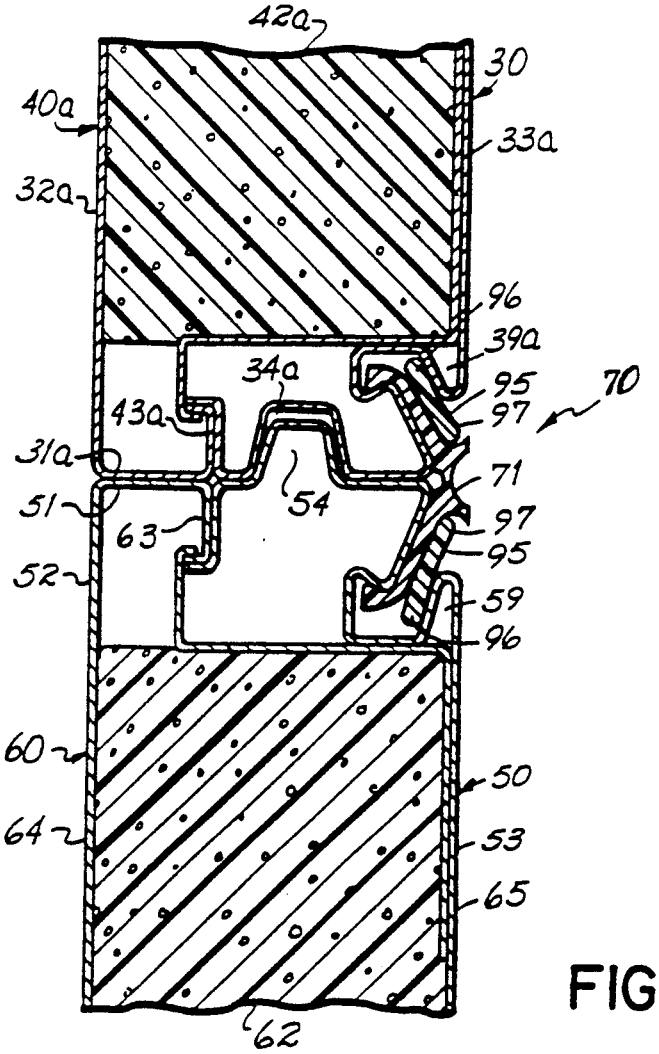
FIG. 3 is a cross-sectional view similar to that of FIG. 2 of an upward acting door along lines 1—1 of FIG. 4, but displaying an alternative plastic hinge assembly.

As an alternative to the V-shape elongated, longitudinal retainer slats 90, it is contemplated within the scope of this invention that elongated, longitudinal retainer slats 95 as illustrated in FIG. 3 may be used. As shown therein, elongated retainer slats 95 are designed with only first and second longitudinal edges 96 and 97 that can be used to lock flexible hinge 70 in place. Like retainer slats 90, alternative retainer slats 95 are wedged between the exterior sides 78 of longitudinal arm flanges 73 or 74 of flexible hinge 70 and short flanges 59 or 39*a* of back flanges 53 or 33*a*, respectively. Unlike retainer slats 90, however, when alternative retainer slats 95 are employed, the back sides 45*a* and 65 of panel sections 30 and 50, respectively, when in an abutting relationship, are not continuously smooth with flexible hinge 70 and retainer slats 95. Moreover, alternative retainer slats 95 are designed with somewhat of an arcuate shape for easy installation as shown in FIG. 3.

Figure 7:
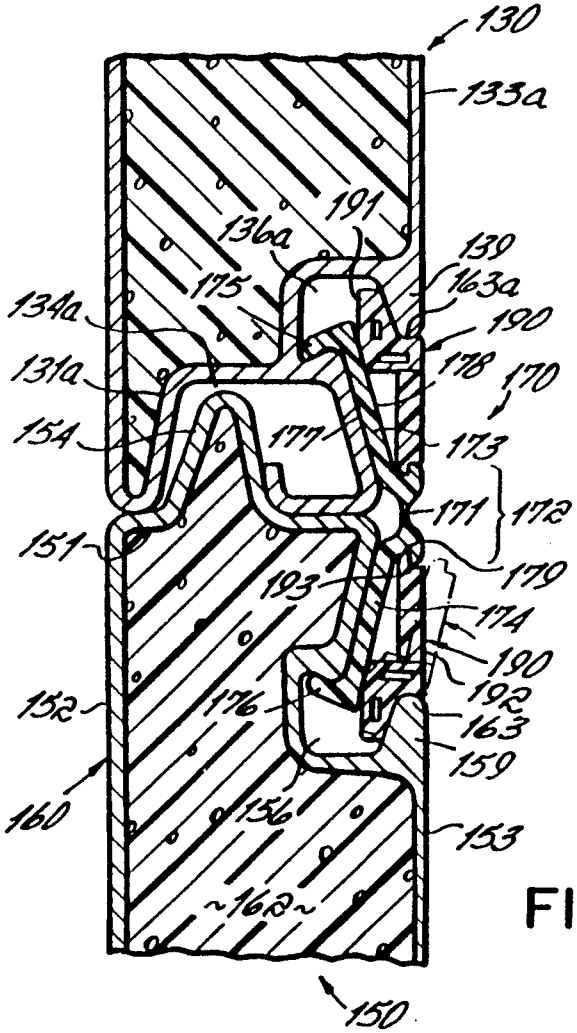
FIG. 7 is a cross-sectional view of a portion of the alternative upward acting door and compressible plastic hinge assembly of FIG. 6 in an assembled form.
Figure 6:
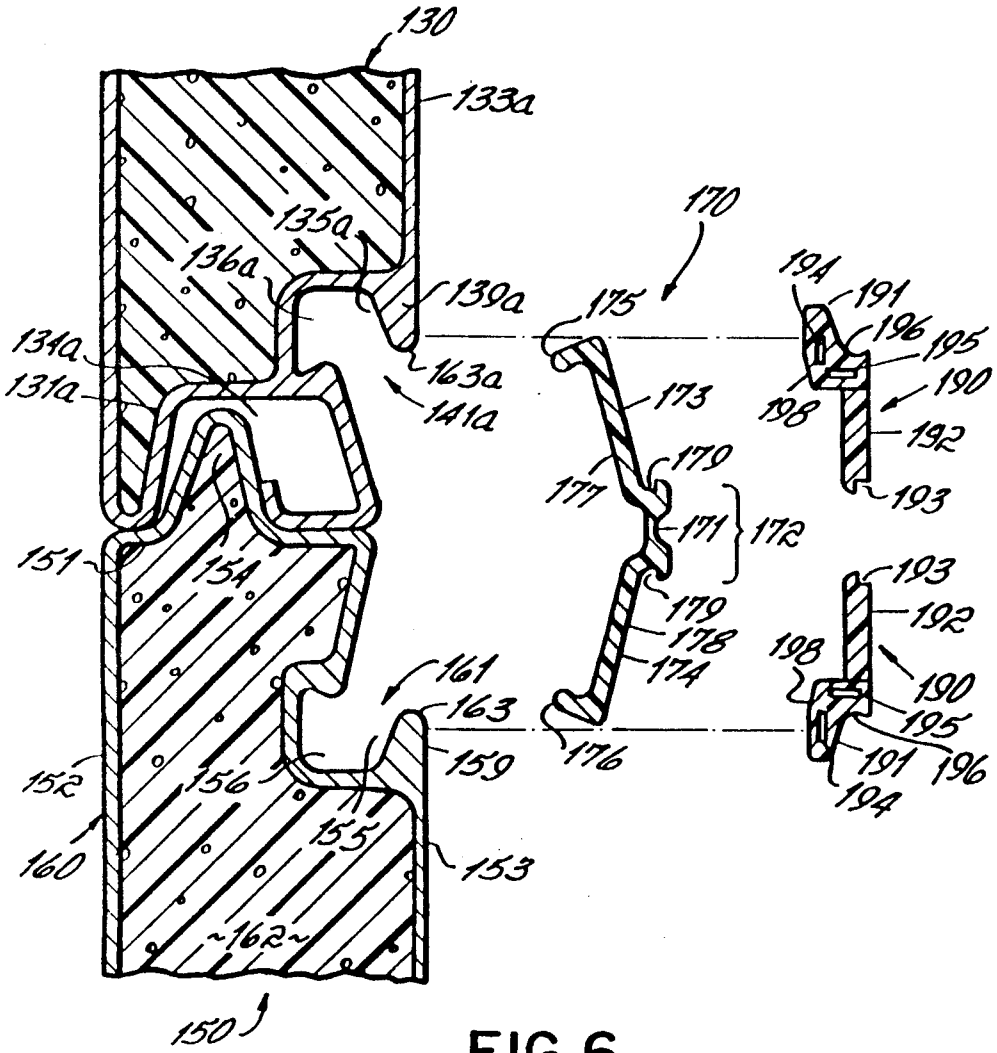
FIG. 6 is a cross-sectional exploded view of a portion of an alternative unassembled upward acting door and compressible plastic hinge assembly taken along lines 1—1 of FIG. 4.

As another alternative flexible hinge assembly to those illustrated in FIGS. 1–3 and 5, it is contemplated within the scope of this invention that a longitudinal flexible hinge in combination with compressible longitudinal retainer slats as depicted in FIGS. 6–7 may be used. As shown in FIGS. 6–7, they show abutting edges of elongated panel sections 130 and 150 with flexible hinge 170, in engagement therewith, of a portion of a door in a closed or lowered and unassembled position or a closed or lowered and assembled position, respectively. The lower elongated panel section 150 comprises a generally U-shaped structure 160 at one end thereof formed of, for example, extruded aluminum (6063-T5 grade), steel, or other metal, plastic or the like with a base 151 and two upstanding, parallel front and back flanges 152 and 153, respectively, in spaced relationship. As part of base 151, a tongue 154 is formed. Thus, components 151–154 can be generally referred to as a tongue rail structure 160. It should be understood that the tongue rail structure 160 may be a continuous frame which encloses the panel sections as shown in FIGS. 6 and 7, or it may be in a separate generally U-shaped construction (with tongue 154) connected at one end to another outer support rail member to form the panel sections (not shown).

Front flange 152 preferably is connected integrally and longitudinally along the front edge of base 151. Back flange 153 is preferably connected integrally and longitudinally along the upper edge of an elongated, longitudinal slot 155 and at the back or inside edge of base 151, as shown in FIGS. 6 and 7. Elongated slot 155 is further provided and in communication with an elongated, longitudinal recess 156. Both slot 155 and recess 156 are formed by back flange 153.

Slot 155 is partially closed by an elongated short flange 159 extending longitudinally along back flange 153 and upwardly but short of the underside base 151, leaving a gap for the insertion of flexible to hinge 170 into elongated slot 155. Short flange 153 is preferably provided with an arcuate, convexed head 163 as shown in FIGS. 6 and 7. Together, slot 155, recess 156 and short flange 159, all of which are formed by back flange 153, form an overall elongated, longitudinal slot 161 which extends longitudinally along back flange 153 near the back or inside edge of base 151.

Filled within the tongue rail structure 160 of lower panel section 150 between base 151 and front and back flanges 152 and 153, respectively, is a light weight, preferably insulative foam 162 comprised of, for instance a polyurethane or the like. As an alternative, an expanded polystyrene bead board or rigid foam may be used. Of course, it should be understood that panel sections which are not filled with a foam can also be employed with this invention.

Since the upper panel section 130 is substantially complimentary to that of lower panel section 150, the corresponding members have been designated with corresponding numbers in the 130*s*, 140*s* and 160*s*, respectively, and having the suffix (a) appended thereafter. The main difference between upper and lower panel sections 130 and 150, respectively, lies in the formation of the base wherein the upper base 151 of lower panel section 150 is shaped with an elongated, longitudinal tongue 154 whereas the lower base 131*a* of upper panel section 130 is shaped with an elongated, longitudinal groove 134*a* which mates with longitudinal tongue 154 when upper and lower panel sections 130 and 150, respectively, are in an abutting or adjoining relationship.

Turning now to a more detailed discussion of FIGS. 6 and 7, they show that panel sections 130 and 150 are hingedly secured to each other so that when the door is being opened or closed, panel sections 130 and 150 will be in different planes as they ride over the bend in tracts 15 and 16. It can easily be seen that elongated flexible hinge 170 flexes longitudinally along a central recessed axis. The recessed area 171 is provided by a thin section in central web 172 of hinge 170. Elongated central web 172 is located between major arm flanges 173 and 174. Elongated arm flanges 173 and 174 extend at a generally acute to linear angle away from main centrally, longitudinally recessed web 172. Longitudinal anchoring flanges 175 and 176 are connected to the free ends of longitudinal arm flanges 173 and 174, respectively, and extend at a generally perpendicular angle away from central web 172 when hinge 170 is in a linear orientation. Flexible hinge 170 is provided with interior and exterior sides 177 and 178, respectively. Central web 172 is provided with a pair of elongated, longitudinal grooves 179 extending along the exterior surface 178 of central web 172 and spaced from each other. It should be understood, however, that when flexible hinge 170 is in an unassembled form, it may be linear shape or V-shape cross section as illustrated in FIGS. 6–7.

Once inserted into overall elongated slots 161 and 141*a* of abutting panels, flexible hinge 170 is generally of V-shape cross-section with the anchoring flanges 175 and 176 being integrally connected to the free edges of longitudinal arm flanges 173 and 174 on the interior side of flexible hinge 170; the interior anchoring flanges 175 and 176 being positioned generally perpendicular to the spaced longitudinal arm flanges 173 and 174. The interior sides of arm flanges 173 and 174 and anchoring flanges 175 and 17 are shaped so as to engage the interior surfaces of back flanges 153 and 133*a* and longitudinal recesses 156 and 136*a* of lower and upper panels 150 and 130, respectively, as depicted in FIGS. 6–7. The anchoring flanges 175 and 176 form short stubs for anchoring flexible hinge 170 within the overall elongated, longitudinal slots 161 and 141*a* of lower and upper panel sections 150 and 130, respectively.

Once flexible hinge 170 has been inserted into the V-shape cross-section overall elongated slots 141*a* and 161 in upper and lower panel sections 130 and 150, respectively, by the insertion of longitudinal arm flanges 173 and 174 into mating slots 135*a* and 155 and longitudinal recesses 136*a* and 156, respectively, longitudinal compressible retainer slats 190 are snapped into upper and lower panel sections 130 and 150, respectively, in contact with arm flanges 173 and 174 to lock flexible hinge 170 in place. Elongated, longitudinal compressible retainer slats 190 are comprised of generally linear structures designed to cooperate with short flanges 159 and 139*a*, the exterior sides 178 of longitudinal arm flanges 173 and 174 of flexible hinge 170 and the central web 172 of flexible hinge 170.

More particularly, longitudinal elongated compressible retainer slats 190 comprise a compressible member 191 and a longitudinal arm 192. Longitudinal arm 192 is connected to compressible member 191 and is preferably formed of a rigid material for assisting in supporting the load of the assembled door when panel sections 130 and 150 are in an abutting relationship, as shown in FIG. 7. At the end of each arm 192 opposite the compressible member 191 is a longitudinal notch 193 for mating with a corresponding longitudinal groove 179 of central web 172 of flexible hinge 170 to lock the retainer slats in place. While longitudinal elongated arm 192 may be formed with a rigid material or a material similar to that selected to form compressible member 191, hinge 170 or central web 172, longitudinal notch 193 thereof is preferably formed of a rigid material to ensure that longitudinal groove 179 of central web 172 and longitudinal notch 193 of arm 192 form an effective lock following installation and during use. Preferably, compressible member 191 and arm 192 are of a design such that when they are installed into longitudinal slots 161 and 141*a*, they form a smooth and flush surface with back flanges 153 and 133*a* when panel sections 130 and 150 are in an abutting relationship.

It should be appreciated that while central web 172 is described as being formed with elongated grooves 179 and retainer slats 190 are described as being formed with a mating notch 193 at each one end thereof, other lock constructions are contemplated by the instant invention. For example, the central web 172 and the end of each arm 192 can be formed with, for example, a zip lock construction or the like to lock the retainer slats 190 and flexible hinge 170 to one another.

Compressible member 191 is uniquely designed for inserting into mating slots 155 or 135(*a*) to be wedged between the exterior sides 178 of longitudinal arm flanges 173 or 174 of flexible hinge 170 and short flanges 159 or 139*a* of back flanges 153 or 133*a*, respectively. For instance, compressible member 191 includes an angled surface 198 for forming an abutting relationship with one exterior side 178 of one arm flange 173 or 174 of flexible hinge 170, and an arcuate, concaved-like section 196 for mating with arcuate, convexed head 163 or 163*a* of short flange 159 on 139*a*, respectively, during installation and use. In addition, compressible member 191 is preferably provided with voids 194 and 195. Voids 194 and 195 are preferably longitudinal and pass entirely through compressible member 191. While elongated void 194 somewhat compresses during installation, it is primarily provided to reduce materials required to form compressible member 191. Elongated void 195, however, is strategically located to permit compressible member 191 to compress or collapse when the concaved section 196 of the compressible member 191 is pressed against the concaved head 163 or 163*a* of short flange 159 or 139*a*, respectively, during installation or disassemblage and use, especially in those instances when the load following installation is increased thereon. It should be appreciated, however, that compressible member 191 may be formed without voids 194 and/or 195. In addition, arcuate heads 163 and 163*a* provide a pivot point for compressible retainer slats 190 during installation to assist in snapping the compressible retainer slats 190 in place or removing the compressible retainer slats 190 therefrom. This is shown in phantom in FIG. 7.

This unique construction of the compressible flexible hinge assembly provides for easy installation and replacement of parts. For example, and as shown in phantom in FIG. 7, as compressible retainer slat 190 is introduced into longitudinal slot 161 or 141*a*, the arcuate, convexed section 196 is positioned on a corresponding arcuate, concaved head 163 or 163*a* of short flange 159 or 139*a*, respectively, compressed at void 195, and pivoted to permit notch 193 of arm 192 to be positioned into longitudinal groove 179 of central web 172 of hinge 170 and locked in place. In squeezing retainer slat 191 into place, void 194 will also be compressed to some degree. When removing a retainer slat 190 during disassemblage, void 195 is again compressed by pressing compressible member 191 notch 193 and pivoting the retainer slat 190 outwardly from the longitudinal slot 161 or 141*a* so that the retainer slat 190 can be easily removed therefrom. Moreover, this unique construction permits the compressible hinge assembly to adjust to tolerance variations due to, for example, manufacturing imperfections, load increases following installations and changes in environmental conditions, to maintain effective operation of assembled sectional or upward acting doors.

As still another alternative construction, short flange 163 or 139*a* of one panel section 150 or 130, respectively, may be extended to form an integral locking member (not shown) to eliminate the need for one retainer slat 190. The locking member may be shaped, for example, in a form identical to the rigid arm 192 and notch 193 of retainer slat 190 or similar to longitudinal arm 92 of retainer slat 90 or retainer slat 95. This alternative construction uniquely permits one flange 73 or 74 or 173 or 174 of flexible hinge 70 or 170, respectively, to be inserted either longitudinally or snapped into the modified elongated slot 61 or 41*a* or 161 or 141*a* in advance. Under this alternative construction, only one separate compressible retainer slat similar to 90, 95 or 191 is then required to adjoin and lock abutting panel sections 50 and 30 or 150 and 130 to one another for articulation.

The material of which flexible hinge 70 and retainer slats 90 or 95 and longitudinal rigid arms 192 of compressible retaining slats 190 are formed can be of any suitable light weight material. Of course, central web 72 or 172 and in particular the recessed area 71 or 171 of central web 72 or 172 is formed of a material which is resistant to fatigue upon flexion, and preferably increases in strength upon flexion. For example, any high molecular weight polymer, such as polypropylene or a polyallomer plastic or the like may be employed. The name polyallomer is applied to block copolymers which have a highly ordered crystalline structure of polypropylene and ethylene. Moreover, flexible hinge 70 or 170 and retainer slats 90, 95 and 190 can be produced by, for instance, standard extrusion or coextrusion technology which, of course, is well known to those versed in the extrusion art.

Exemplary of typical commercial polymers that may be used to produce flexible hinge 70 or 170 when it is extruded include a polypropylene sold by Fina Oil & Chemical under product number #3622 or a polyallomer sold by Eastman Kodak under the trademark Tenite and product number 5021. When hinge 70 or 170 is coextruded, central web 72 or 172 and in particular recessed area 71 or 171 is preferably formed with an elastomer material whereas arm flanges 73, 74 or 173, 174 may be formed with a rigid polymer. Examples of elastomers that may be used include a polyester elastomer sold by DuPont under the trademark Hytrel, a fluoroelastomer also sold by DuPont under the trademark Viton and a thermoplastic rubber elastomer marketed by Shell Chemical under the trademark Kraton. Of course, it should be understood that it is believed that compressible member 191 may be formed with these above-recited elastomers as well as compressible urethanes, such as a reaction injection molded urethane. The rigid polymers that may be used in the coextrusion process to form arm flanges 73, 74 or 173, 174 or rigid arms 192 include a polyvinyl chloride (PVC) sold by Goodyear under the trademark Geon and product number 83 or an acrylonitrile-butadiene-styrene (ABS) marketed by Dow Chemical under the trademark Magnum and product number 350. These, as well as other suitable rigid polymers may also be used to form slats 90 and 95 and the rigid arms 192 of retaining slats 190. In addition, polymers such as a polypropylene sold by Fina Oil & Chemical under product number 3622 or a polycarbonate marketed by Maobay under the trademark Makrolon under product number 3200 may be used for slats 90 and 95 or the longitudinal rigid arms of 192 of compressible retaining slats 190.

The alternative compressible flexible hinge assembly as shown in FIGS. 6 and 7 may be formed with, for example, the following materials available through the Geuga Company, a division of the Carlisle Corporation, Crestline, Ohio. For the flexible hinge 170, it may be formed with Geuga's high-grade polypropylene, Product No. 60531-010. For the compressible member 191 and the rigid arm 192, they may be formed with Geuga's general purpose compressible polyvinyl chloride, Product No. 6015 and Geuga's general purpose rigid polyvinyl chloride, Product No. 60499, respectively.

As previously referred to hereinabove, one of the advantages associated with the novel flexible hinge assemblies of the present invention is that they can be designed to thermally self-adjust, so that changes in the curvature of the door, caused by heat, cold or wind, can be adjusted to permit the panel sections hingedly connected by the novel flexible hinge assemblies to still operate. This is accomplished by virtue of the fact that the flexible hinge component is not affixed to either abutting panel section thereby permitting the flexible hinge to adjust to any curvatures imparted to the door resulting from, for example, thermal bowing or wind load.

In summary, a novel flexible hinge arrangement is provided to form a weather-tight seal between sectional panels of an upward acting door having a long effective life. The flexible hinge assemblies and their retainer slats can be inserted from the back sides or faces 45*a* and 65 or 145*a* and 165 of panel sections 30*a* and 50 or 130*a* and 150, respectively, rather than from their ends. Thus, the unique design of flexible hinge 70 or 170 and retainer slats 90, 95 or 195 permits installation or disassemblage to be done without tools and may shorten the time required to assemble or disassemble door 10, respectively. As can now be appreciated, the novel flexible hinge assemblies result in a superior appearance on the back sides or surfaces 45*a* and 65 or 145*a* and 165 of the garage doors or sectional doors since there are no unsightly metal hinges, straps and bolts. The novel flexible hinge arrangements also eliminate interior pinch points between panel sections 30*a* and 50 or 130*a* and 150 when they are in different planes as they ride over the bend in tracts 15 and 16.

The present invention may, of course, be carried out in other specific ways than those herein set forth without departing from the spirit and essential characteristics of the invention. The present embodiments are, therefore, to be considered in all respects as illustrative and not restrictive and any changes coming within the meaning and equivalency range of the appended claims are to be embraced therein.

Having described my invention, what we claim is:

1. An elongated compressible flexible hinge assembly for hingedly securing together abutting panel sections of a sectional door for articulation of the panel sections with respect to each other, each said panel section having a back side surface and an elongated slot defined by a short flange along the back side surface, said compressible flexible hinge assembly comprises:

an elongated flexible hinge having a central web formed of a material which is substantially resistant to flexure fatigue, said central web further having first and second ends wherein each said end is connected to an elongated flange, said flanges being spaced apart from one another, one said flange being adapted to be inserted into one said elongated slot of one said abutting panel section and said other flange being adapted to be inserted into said other elongated slot of said other abutting panel section for hingedly connecting said abutting panel sections to one another in an abutting relationship; and two elongated compressible retainer slats for said elongated flexible hinge, each said compressible retainer slat having the ability to compress when being inserted into one of the elongated slots of one abutting panel section, so that each said compressible retainer slat can be positioned between the short flange of one abutting panel section and the central web of said elongated flexible hinge for locking said elongated flexible hinge in the elongated slots of the abutting panel sections.

2. An elongated flexible hinge assembly of claim 1 wherein said flanges are formed of a material which is substantially resistant to flexure fatigue.

3. An elongated flexible hinge assembly of claim 1 wherein said material is an elastomer.

4. An elongated flexible hinge assembly of claim 3 wherein said elastomer is selected from the group consisting of a polyester elastomer, a fluoroelastomer and a thermoplastic rubber elastomer.

5. An elongated flexible hinge assembly of claim 1 wherein said central web is formed with an elastomer and said flanges are formed with a rigid thermoplastic material.

6. An elongated flexible hinge assembly of claim 5 wherein the elastomer is selected from the group consisting of a polyester elastomer, a fluoroelastomer and a thermoplastic rubber elastomer, and the rigid thermoplastic material is selected from the group consisting of a polyvinyl chloride and an acrylonitrile-butadiene-styrene polymer.

7. An elongated flexible hinge assembly of claim 1 wherein said elongated flexible hinge is formed with a material selected from the group consisting of a polypropylene and polyallomer.

8. An elongated flexible hinge assembly of claim 1 wherein said elongated compressible retainer slats are formed with a thermoplastic material selected from the group consisting of a polyvinyl chloride, an acrylonitrile-butadiene-styrene polymer, polypropylene, polycarbonate and a polyallomer.

9. An elongated flexible hinge assembly of claim 1, said compressible retainer slat comprising a compressible member connected to an arm.

10. An elongated flexible hinge assembly of claim 9, said compressible member having a void for permitting said compressible member to compress during installation and removal of said compressible retainer slats.

11. An elongated flexible hinge assembly of claim 9, each said compressible member having an arcuate concaved section and each of the short flanges having an arcuate convexed head for cooperation with one said corresponding arcuate concaved section for providing a pivot point during installation and removal of said compressible retainer slats.

12. An elongated flexible hinge assembly of claim 9, said central web having a pair of elongated grooves spaced apart from one another and each said arm of each said compressible retainer slat having a notch at the end thereof opposite said compressible member for mating with one elongated groove of said central web for locking said flexible hinge and compressible retainer slat into the elongated slots of the abutting panel sections.

13. A hinged sectional door comprising:

two abutting panel sections, each said panel section having front and back side surfaces and abutting longitudinal edges, each said panel section having an elongated slot defined by a short flange along the back side surface adjacent the abutting edge, each said elongated slot having an interior surface and being angled acutely with respect to the back side surface;

an elongated flexible hinge comprising first and second arm flanges having interior and exterior surfaces, each said arm flange being connected to a central web and spaced from the other, one said arm flange being inserted into one said elongated slot in one said abutting panel section and said other arm flange being inserted into said other elongated slot in said other abutting panel section for hingedly connecting said panel sections in an abutting relationship; and two elongated compressible retainer slats, each said elongated compressible retainer slat having the ability to compress when being inserted into one of said elongated slots between the exterior surface of one said arm flange and the interior surface of one said elongated slot so that each said elongated compressible retainer slat can be positioned between one said short flange and said central web of said hinge for locking said elongated flexible hinge said in said elongated slots of said abutting panel sections for articulation of said abutting panel sections with respect to each other.

14. A hinged sectional door as recited in claim 13 wherein the central web of said elongated flexible hinge is comprised of a plastic material which is substantially resistant to fatigue when the material is continuously flexed.

15. A hinged sectional door as recited in claim 14, the abutting longitudinal edge of one said abutting panel section having a second elongated slot for receiving therein a corresponding elongated tongue on the abutting longitudinal edge of said other abutting panel section so that when said abutting panel sections are in an abutting relationship said elongated tongue mates with said second elongated slot.

16. A hinged sectional door as recited in claim 13, said compressible retainer slat comprising a compressible member connected to an arm.

17. A hinged sectional door as recited in claim 16, said compressible member having a void for permitting said compressible member to compress during installation and removal of said compressible retainer slats.

18. A hinged sectional door as recited in claim 16, each said compressible member having an arcuate concaved section and each of the short flanges having an arcuate convexed head for cooperation with one said corresponding arcuate concaved section for providing a pivot point during installation and removal of said compressible retainer slats.

19. A hinged sectional door as recited in claim 14, said central web having a pair of elongated grooves spaced apart from one another and each said arm of each said compressible retainer slat having a notch at the end thereof opposite said compressible member for mating with one elongated groove of said central web for locking said flexible hinge and compressible retainer slat into the elongated slots of the abutting panel sections.

20. A hinged sectional door comprising:

at least two abutting panel sections, each said panel section having front and back side surfaces and an abutting elongated edge, each said abutting panel section further having an elongated slot defined by a short flange along said back side surface adjacent said abutting edge and at a generally acute angle to said back side surface, said elongated slot having an interior surface;

at least one elongated flexible hinge of generally V-shape to linear cross-section for hingedly securing said abutting panel sections together for articulation with respect to each other, said elongated flexible hinge having an elongated central web portion connected to a pair of elongated arm flanges spaced from each other, each said elongated arm flange having interior and exterior side surfaces and being inserted into one said elongated slot of one said abutting panel section, said elongated central web further having an exterior side surface and an elongated recess area along said exterior side surface for flexing thereat, said elongated central web further having a pair of elongated grooves extending along the exterior side surface and spaced from each other; and at least two elongated compressible retainer slats, each said retainer slat having a compressible member connected to a rigid arm, each said compressible member of each said retainer slat having the ability to compress when placed in contact with one said corresponding short flange while being inserted into or removed from one said elongated slot so that each said slat can be positioned between or removed from the exterior side surface of one said elongated arm and the interior surface of said elongated slot, each said rigid arm of each said retainer slat being inserted into one said elongated groove of said elongated central web for locking said elongated flexible hinge in said elongated slots in said abutting panel sections.

21. A hinged sectional door as recited in claim 20 wherein said elongated central web of said elongated flexible hinge is comprised of a plastic material which is substantially resistant to fatigue when the material is continuously flexed.

22. A hinged sectional door as recited in claim 20, said elongated flexible hinge further having a pair of outwardly extending anchoring flanges facing away from the interior side surfaces and being individually connected to free ends of said elongated arm flanges of said elongated flexible hinge for further locking said elongated flexible hinge in said elongated slots upon the insertion of each said elongated arm flange into one said elongated slot of one said abutting panel section.

23. A hinged sectional door as recited in claim 20, said compressible member having a void for permitting said compressible member to compress during installation of said slots.

24. A hinged sectional door as recited in claim 20, one said abutting elongated edge of one said abutting panel section further includes an elongated second slot for receiving therein a corresponding elongated tongue on said abutting elongated edge of said other abutting panel section so that when said abutting panel sections are in an abutting relationship said elongated tongue mates with said elongated second slot.

25. A hinged sectional door as recited in claim 20, each said compressible member having an arcuate concaved section and each of the short flanges having an arcuate convexed head for cooperation with one said corresponding arcuate concaved section for providing a pivot point during installation and removal of said compressible retainer slats.

26. A hinged sectional door as recited in claim 20, said central web having a pair of elongated grooves spaced apart from one another and each said arm of each said compressible retainer slat having a notch at the end thereof opposite said compressible member for mating with one elongated groove of said central web for locking said flexible hinge and compressible retainer slat into the elongated slots of the abutting panel sections.

27. An elongated flexible hinge assembly for hingedly securing together abutting first and second panel sections of a sectional door for articulation of the panel sections with respect to each other, the first said panel section having a back side surface and an elongated slot defined by a short flange along the back side surface, the second said panel section having a back side surface and an elongated slot defined by a locking member along the back side surface, said flexible hinge assembly comprises:

an elongated flexible hinge having a central web formed of a material which is substantially resistant to flexure fatigue, said central web further having first and second ends wherein each said end is connected to an elongated flange, said flanges being spaced apart from one another, one said flange being adapted to be inserted into said elongated slot of said first abutting panel section and said other flange being adapted to be inserted into said elongated slot of said second abutting panel section for hingedly connecting said abutting panel sections to one another in an abutting relationship, said locking member locking said hinge to said second abutting panel section when one said flange is inserted into the elongated slot thereof; and said retainer slat having the ability to be positioned between the short flange of said first abutting panel section and the central web of said elongated flexible hinge for locking said elongated flexible hinge in the elongated slot of said first panel and said first and second panel sections in an abutting relationship for permitting said sections to articulate with respect to one another.

28. A longitudinal retainer slat for locking a longitudinal flexible hinge to a panel section, said longitudinal retainer slat comprises:

a longitudinal compressible member connected to a longitudinal arm, said compressible member having at the end opposite said arm an arcuate concave-like surface for engaging a section of said panel section for providing a pivot point therebetween, said arm having at the end opposite said compressible member means for engaging a section of said flexible hinge, so that said flexible hinge is locked to said panel section via said retainer slat.

29. A longitudinal retainer slat of claim 28, said compressible retainer slat having a void therein for enhancing the compressiblity of said compressible member.

* * * * *

UNITED STATES PATENT AND TRADEMARK OFFICE

CERTIFICATE OF CORRECTION

PATENT NO. : 5,129,441

DATED : July 14, 1992

INVENTOR(S) : Alan R. Leist et al

It is certified that error appears in the above-identified patent and that said Letters Patent is hereby corrected as shown below:

Column 8, line 1, "flanges 175 and 17" should be --flanges 175 and 176--

Column 9, line 36, "member 191 notch 193" should be --member 191 against the short flange 159 or 139a to disengage notch 193--

Signed and Sealed this

Twenty-sixth Day of October, 1993

Bruce Lehman

*Attest:*

BRUCE LEHMAN

*Attesting Officer*

*Commissioner of Patents and Trademarks*